United States Patent [19]

Gessinger et al.

[11] 4,453,985

[45] Jun. 12, 1984

[54] PROCESS FOR THE PRODUCTION OF A FINE-GRAINED WORK PIECE AS FINISHED PART FROM A HEAT RESISTANT AUSTENITIC NICKEL BASED ALLOY

[75] Inventors: Gernot Gessinger; Günther Schröder, both of Birmenstorf, Switzerland

[73] Assignee: BBC Brown, Boveri & Company, Limited, Baden, Switzerland

[21] Appl. No.: 463,015

[22] Filed: Feb. 1, 1983

[30] Foreign Application Priority Data

Feb. 18, 1982 [CH] Switzerland ..... 1019/82

[51] Int. Cl.[3] ..... C22F 1/10

[52] U.S. Cl. ..... 148/11.5 N; 148/12.7 N

[58] Field of Search ..... 148/11.5 N, 12.7 N

[56] References Cited

U.S. PATENT DOCUMENTS 3,677,830 7/1972 Cox et al. ..... 148/11.5 N

*Primary Examiner*—W. Stallard

*Attorney, Agent, or Firm*—Oblon, Fisher, Spivak, McClelland & Maier

[57] ABSTRACT

Using a heat resistant austenitic nickel based alloy, independent of the grain size in the initial material, a fine-grained finished part is produced from an unworked part which was not specially cultivated for fine grain, in a single operational step, consisting of isothermal forging.

3 Claims, 1 Drawing Figure

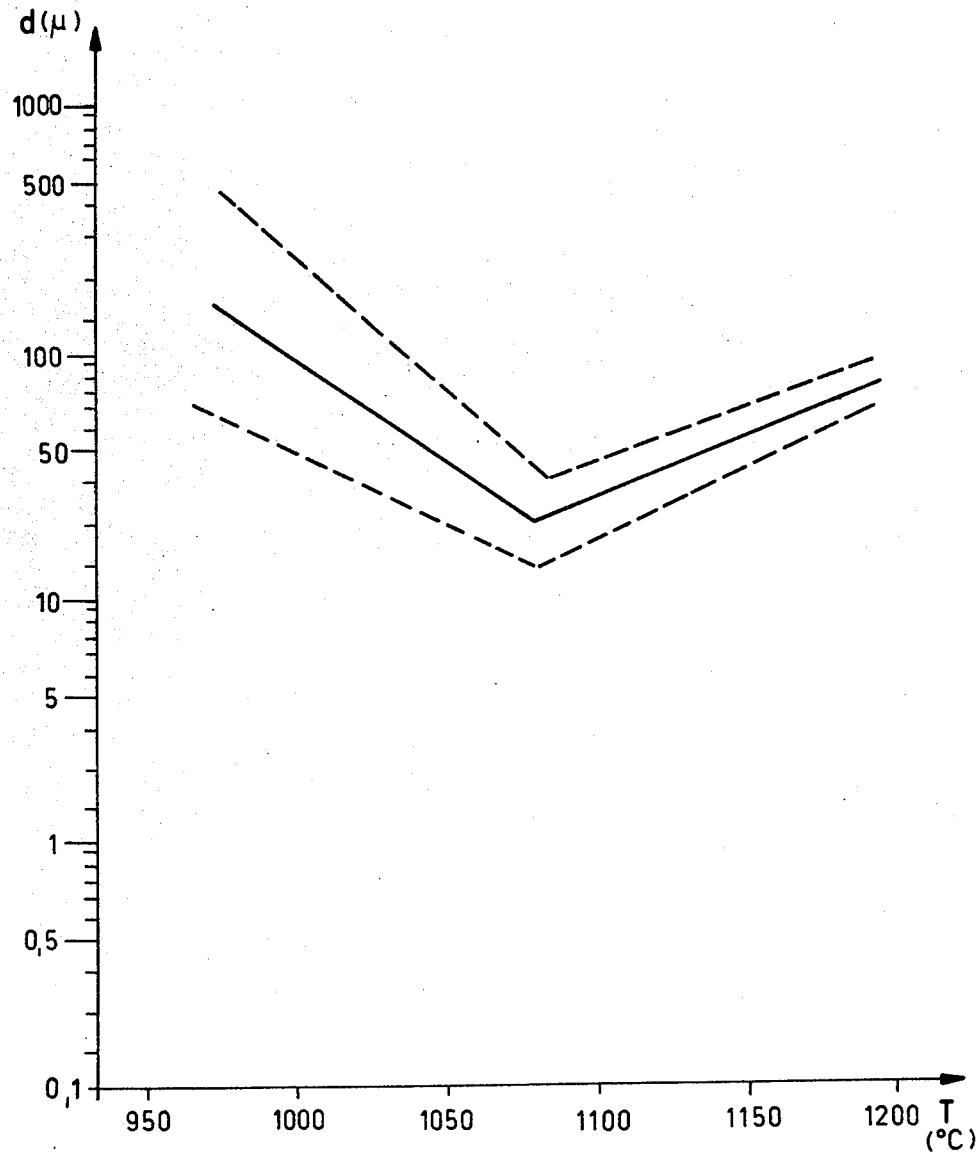
d(μ)
1000
500
100
50
10
5
1
0,5
0,1
950
1000
1050
1100
1150
1200
T
(°C)

PROCESS FOR THE PRODUCTION OF A FINE-GRAINED WORK PIECE AS FINISHED PART FROM A HEAT RESISTANT AUSTENITIC NICKEL BASED ALLOY

The invention is based on a process for the production of a work piece of the type mentioned in claim 1.

From the literature processes are known by which a fine-grained end product can be produced in several operations when starting with an unworked part made out of a heat resistant alloy (e.g. nickel super alloy). This is especially the case with a process in which during a first step—the original material is shaped in a conventional manner just below its recrystallization temperature so that the desired fine-grained texture ensues in an intermediate product. In a second step, this intermediate product is transformed into the final product by quasi isothermal forging with the use of heated forging dies (GB-PS No. 1 253 861).

These processes are costly, inasmuch as it is necessary to prepare several tools simultaneously such as presses, forging dies, etc., and that the shaping of the work piece cannot usually be done in one heat treatment from unworked piece to end product.

The invention is addressed to a process which makes it possible to produce a fine-grained finished part from a heat resistant super alloy—starting with a forging blank of any grain size—in the simplest way, saving time and expense.

This is possible, according to the invention, by the characteristics in claim 1.

The invention may be explained by reference to the example below and using a single FIGURE. The FIGURE shows a diagram with the relationship between shaping temperature and the size of the grain in the final product. On the abscissa is the shaping temperature T in °C. in natural scale, on the ordinate the median crystallide diameter d in $\mu$ in logarithmic scale. The solid line refers to the median values. The broken lines show the upper and lower limits of the range of dispersion, resulting from the variations of initial grain size and the experimental conditions.

The effect is unexpected and surprising, inasmuch as it shows that independent from the grain size in the initial product (unworked piece), and largely also independent of the size of the change in shape—as long as a certain minimal size was maintained—and within a relatively wide range of the shaping speed by isothermal forging, a fine-grained final product could be obtained in a single operation.

OPERATIONAL EXAMPLE I

See the FIGURE.

As basic material a nickel super alloy with the commercial name Waspaloy was used, which has the following composition:

C=0.03 percent by weight
Cr=19.5 percent by weight
Mo=4.5 percent by weight
Co=14.0 percent by weight
Ti=3.0 percent by weight
Al=1.4 percent by weight
Fe=2.0 percent by weight
Ni=remainder The alloy, produced in a metallurgical melting process, was transformed into a bar with a diameter of 165 mm by casting and reforging. The forging blank chosen for the final shaping was a cylindrical bar segment and had a grain size between 150$\mu$ and 450$\mu$. Starting with this unworked piece, a finished part was forged in one single operation from the molybdenum alloy TZM, by isothermal forging in one forging operation, whereby, in each case, the tool temperature was the same as the temperature of the work piece. Several experiments were made with forging blanks of the same dimension and same initial grain size, but with varying shaping temperatures. Those were, in sequence, 980° C., 1080° C. and 1180° C. In addition, the shaping speeds $\dot{\epsilon}$ were varied between $1\times10^{-3}\text{sec}^{-1}$ and 1 $\text{sec}^{-1}$. $\dot{\epsilon}$ is defined as follows:

$$\epsilon = d\frac{\left|\ln\frac{A_0}{A_f}\right|}{dt}$$

$A_0$=surface of cross section of work piece before reshaping
$A_f$=surface of cross section of work piece after reshaping
ln=natural logarithm
t=time in seconds As shown in the FIGURE, considerable grain refinement in the texture of the work piece occurred with a maximum refinement occurring at a shaping temperature of 1080° C. A median crystallide diameter down to 20$\mu$ was attained. Surprisingly, it was possible to attain this grain refinement already at relatively low shaping grades $\dot{\epsilon}$. In addition, it was observed that the final grain size obtained was essentially independent of the initial grain size, that the material received a grain of higher uniformity during the shaping process, in spite of varying grain sizes in the initial material.

OPERATIONAL EXAMPLE II

The initial material chosen was an iron containing nickel super alloy with the designation IN 718 and the following composition:

C=0.05 percent by weight
Cr=18.5 percent by weight
Ni=53.0 percent by weight
Mo=3.0 percent by weight
Nb=5.3 percent by weight
Ti=1.0 percent by weight
Al=0.5 percent by weight
Fe=remainder Following the procedure described in example I, forging blanks with a diameter of 165 mm were made into finished parts by isothermal forging. The median grain size of the initial material was about 300$\mu$. With a shaping temperature of 1050° C., a median final grain size of 22$\mu$ was obtained. The shaping speeds were $1\times10^{-3}\text{sec}^{-1}$ to 1 $\text{sec}^{-1}$, the degree of shaping 1.4. The latter is defined as follows:

$$\epsilon = \ln\frac{A_0}{A_f}$$

The invention is not limited to the operational examples. Super alloys with the commercial names Astroloy, Nim 901, IN 100, Rene 95, MERL 76, A 286, and similar may serve as initial materials. The shaping temperature may be between about 960° C. and 1200° C., but it depends on the composition of the alloy, the dimension of the work piece and other procedural parameters and which may be determined, case by case, by practical experiments.

The process according to the invention makes it possible to transform forging blanks made from super alloys—independent of the texture in the initial material—into a fine-grained end product (finished part) in a single operation in only one heat treatment.

What is claimed:

1. A process for the production of a fine-grained work piece as a finished part with a median crystallide size of not more than 100μ from a heat resistant austenitic nickel based alloy, whereby the initial material may have any crystallide size, characterized by the fact that the forging blank is transformed in a single operational step within a temperature range of between 960° C. and 1200° C. and with a shaping speed $\dot{\epsilon}$ of $1\times10^{-1}$ to 1 $sec^{-1}$, by isothermal forging in one forging process into the final product, whereby $\dot{\epsilon}$ is defined as follows:

$$\dot{\epsilon} = d\frac{\left|\ln\frac{A_0}{A_f}\right|}{dt}$$

$A_0$=surface of cross section of work piece before reshaping $A_f$=surface of cross section of work piece after reshaping ln=natural logarithm t=time in seconds 2. The process according to claim 1, characterized by the fact that the nickel based alloy has the following composition:

C: 0.03 percent by weight
Cr: 19.5 percent by weight
Mo: 4.5 percent by weight
Co: 14.0 percent by weight
Ti: 3.0 percent by weight
Al: 1.4 percent by weight
Fe: 2.0 percent by weight
Ni: remainder and that the shaping of the work piece is done at a temperature of 1080° C. with a speed $\dot{\epsilon}$ of $10^{-3}$ to 1 $sec^{-1}$.

3. The process according to claim 1, characterized by the fact that the nickel based alloy has the following composition:

C: 0.05 percent by weight
Cr: 18.5 percent by weight
Ni: 53.0 percent by weight
Mo: 3.0 percent by weight
Nb: 5.3 percent by weight
Ti: 1.0 percent by weight
Al: 0.5 percent by weight
Fe: remainder and that the shaping of the work piece is done at a temperature of 1050° C. with a speed $\dot{\epsilon}$ of $10^{-3}$ to 1 $sec^{-1}$.

* * * * *